United States Patent [19]

Trainor

[11] 4,046,473

[45] Sept. 6, 1977

[54] PHOTORECEPTOR METHOD AND SYSTEM

[75] Inventor: John W. Trainor, Pittsford, N.Y.

[73] Assignee: Xerox Corporation, Stamford, Conn.

[21] Appl. No.: 575,304

[22] Filed: May 7, 1975

[51] Int. Cl.[2] ..... G03G 15/00

[52] U.S. Cl. ..... 355/16; 96/1 R; 355/3 R

[58] Field of Search ..... 355/3 R, 14, 16, 17, 355/3 BE; 96/1 R, 1.3

[56] References Cited

U.S. PATENT DOCUMENTS

| | | | |
|---|---|---|---|
| 3,155,022 | 11/1964 | Schwertz | 355/16 X |
| 3,495,903 | 2/1970 | Morley et al. | 355/16 |
| 3,500,694 | 3/1970 | Jones et al. | 355/16 X |
| 3,716,294 | 2/1973 | Knechtel et al. | 355/3 R |
| 3,836,245 | 9/1974 | Hastwell et al. | 355/14 X |
| 3,856,396 | 12/1974 | Kushima et al. | 355/14 X |
| 3,926,625 | 12/1975 | van der Sterren | 355/16 X |

*Primary Examiner*—Fred L. Braun

[57] ABSTRACT

In a photoreceptor method and assembly for a photocopy apparatus of the type employing a flexible endless photoreceptor belt, a shuttle mechanism is located between the imaging and processing stations of the photocopy apparatus which simultaneously stores and dispenses portions of the photoreceptor belt to enable the photoreceptor belt to be stopped at the imaging station during imaging and then rapidly removed from that station at high velocity after imaging is completed, while the velocity of the photoreceptor belt at the processing station may be maintained substantially constant.

18 Claims, 5 Drawing Figures

Vc
72
70
19
B
18
17
Vc
46
12b
26
Vs1
30
24
28
68
12a
44
34
40
48
72
Vo
50
66
42
46
A

B
11
55
52
56
54
58
20
24
38
32
42
44
60
36
40
46
48
26
28
50
62
64
4
4
66
12
46
40
38
30
A
34
42
46

PHOTORECEPTOR METHOD AND SYSTEM

BACKGROUND AND SUMMARY OF THE INVENTION

This invention relates to a photoreceptor method and assembly and, more particularly, to a photoreceptor method and assembly for use in a photocopy apparatus.

In photocopy apparatus, and particularly electrostatic copiers having either drum or belt photoreceptors, the maximum copy rate is usually limited by the time it takes to expose the photoreceptor to transfer the image which is to be copied to the photoreceptor. In recent belt photoreceptor apparatus flash exposure of the entire document to image the photoreceptor belt at the imaging station of the apparatus has resulted in substantial increases in copy rate over the prior scanning imaging methods and apparatus previously used. Although flash exposure increases the copy rate, the imaging phase of the copying process still constitutes the limit on the maximum copy rate of the machine. Moreover, flash exposure imaging suffers several disadvantages. One disadvantage is that flash exposure imaging requires light illumination intensities substantially greater than those in prior imaging systems. In addition, the photoreceptors employed in flash exposure imaging must be highly sensitive and held flat during exposure. Thus, only a narrow range of photosensitive materials may be used in such flash exposure systems and, thereby, other materials which have other advantageous physical and mechanical properties frequently can not be used.

In the method and assembly of the present invention, the photoreceptor may be stopped at the imaging station during the time that the image is being transferred to the photoreceptor, even though the photoreceptor continues to move at a constant speed through the processing stations. The ability to slow or stop the photoreceptor at the imaging station during imaging has several advantages. One advantage is that lower light intensities may be employed during imaging, flash or otherwise. Another advantage is that a wider range of photoreceptor materials may be employed. Thus, photoreceptor materials having optimum mechanical properties, e.g. crack resistance, abrasion resistance, good substrate adhesion, etc., may be selected without a reduction of given copy rate, even though the sensitivity of the photoreceptor is reduced. Conversely, for highly sensitive photoreceptors, the method and assembly of the present invention are capable of substantially improved copy rates, in fact, so improved, that the maximum copy rate limit is no longer governed by the imaging limitations. Another advantage of the method and apparatus of the present invention is the improved quality of the copy product. Even in flash exposure systems where image transfer is extremely rapid, the photoreceptor material will still move a small predetermined amount during the time of exposure due to the constant speed of the photoreceptor. This small amount of movement or displacement will cause at least some slight smearing. Conversely, in the photoreceptor assembly and method of the present invention, the photoreceptor may be brought to a complete stop during exposure preventing any such smearing.

In one principal aspect of the present invention, a photoreceptor system for a photocopying apparatus including a flexible endless photoreceptor means, a processing station, an imaging station for transferring the image to be copied to the photoreceptor means, and drive means for driving the photoreceptor means through the processing and imaging stations, includes velocity control means for controlling the velocity of the photoreceptor means such that the velocity at the processing station is substantially constant while the velocity at the imaging station may, simultaneously, be less than the substantially constant velocity.

In another principal aspect of the invention, the velocity control means comprises a movable shuttle means between the imaging and processing stations, whereby the photoreceptor means may be stopped during imaging at the imaging station and then rapidly removed from the imaging station upon completion of imaging.

In still another aspect of the present invention, a method of photocopying comprises driving flexible endless photoreceptor means through imaging and processing stations of a photocopy apparatus, moving the photoreceptor means at a velocity less than a given velocity at the imaging station while transferring the image thereto to be copied, and simultaneously moving the photoreceptor means at the given velocity through the processing station.

In still another principal aspect of the present invention, the velocity in the last mentioned process which is less than the given velocity is zero and the photoreceptor means may also be moved at the imaging station at a velocity greater than the given velocity after the image has been transferred thereto while simultaneously moving the photoreceptor means at the given velocity through the processing station.

These and other objects features and advantages of the present invention will be more clearly understood through a consideration of the following detailed description.

BRIEF DESCRIPTION OF THE DRAWINGS

In the course of this description, reference frequently will be made to the attached drawings in which.

DESCRIPTION OF THE PREFERRED EMBODIMENT

Figure 1:
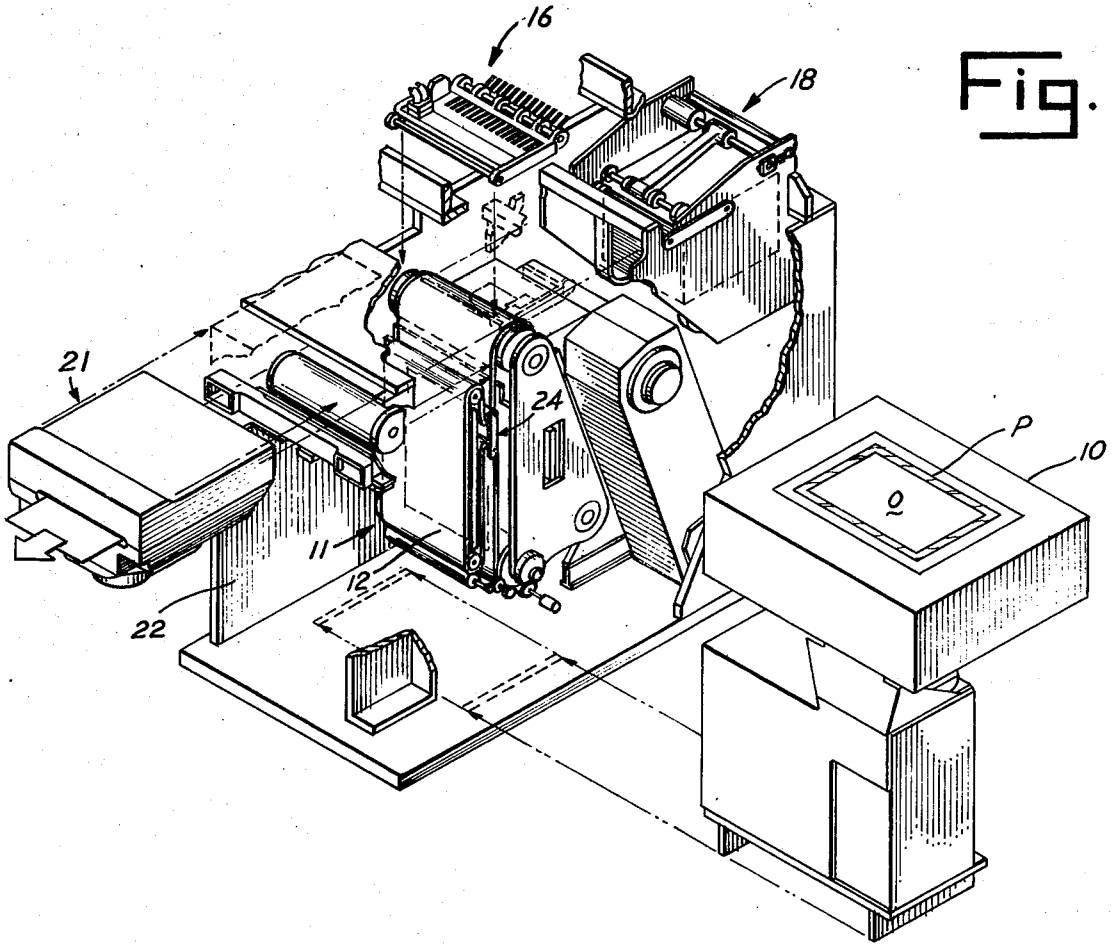
FIG. 1 is an exploded righthand perspective view of a photocopy apparatus incorporating the present invention therein with the components thereof separated to better illustrate the invention.
Figure 2:
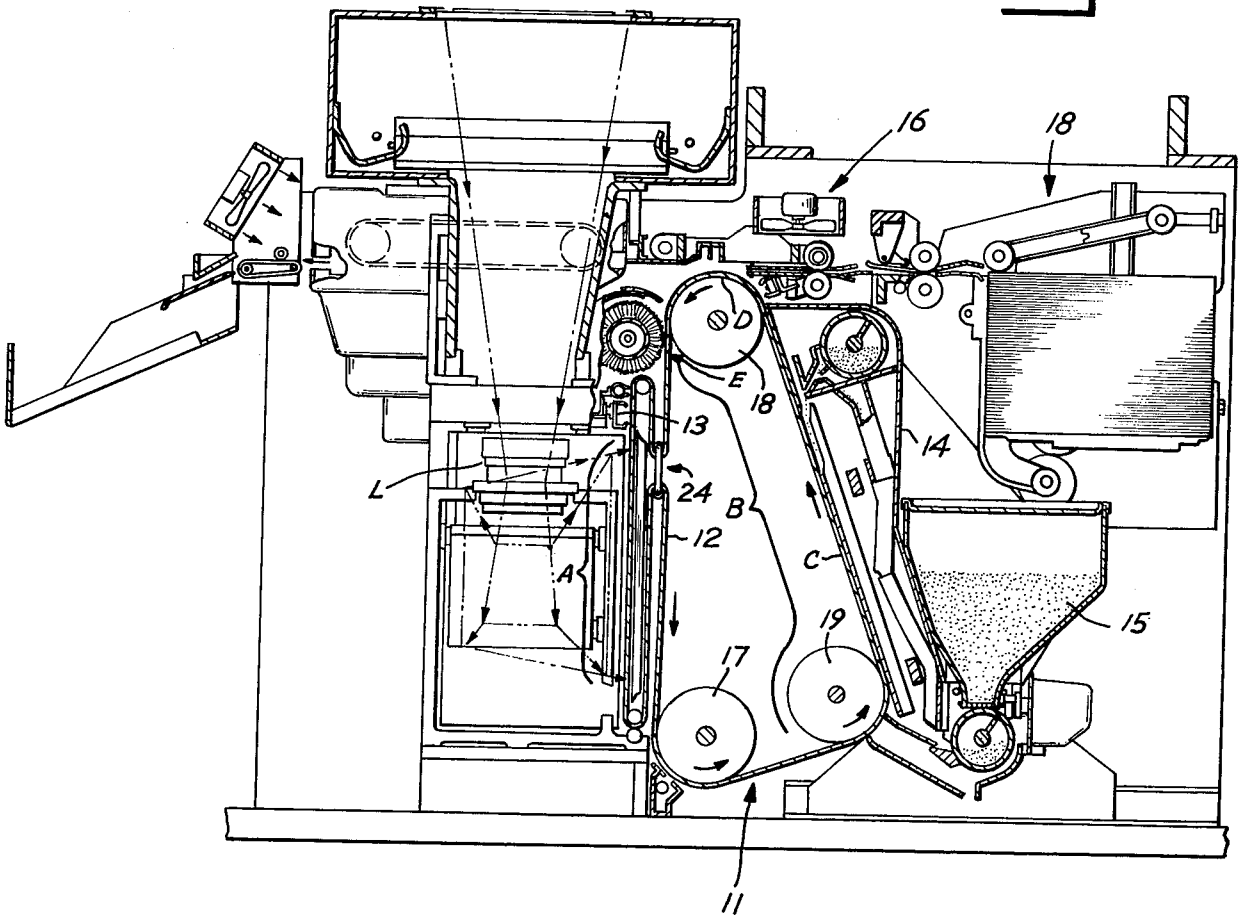
FIG. 2 is a schematic cross sectional view of the photocopy apparatus showing various xerographic processing stations.

For a general understanding of the illustrated copier-reproduction apparatus or machine, in which the invention may be incorporated, reference is had to FIGS. 1 and 2 in which the various system components for the machine are schematically illustrated. As in all electrostatic systems such as xerographic machines of the type illustrated, a light image of a document to be reproduced is projected onto the sensitized surface of a xerographic plate to form an electrostatic latent image thereon. Thereafter, the latent image is developed with an oppositely charged developing material to form a xerographic powder image, corresponding to the latent image on the plate surface. The powder image is then electrostatically transferred to a support surface to which it may be fused by a fusing device whereby the powder image is caused permanently to adhere to the support surface.

Referring to FIGS. 1 and 2, in the illustrated machine an original document O to be copied is placed upon a transparent support platen P fixedly arranged in an illumination assembly generally indicated by the reference numeral 10, arranged at the left end of the machine. While upon the platen, an illumination system, to be described herein, flashes light rays upon the original thereby producing image rays corresponding to the informational areas on the original. The image rays are projected by means of an optical system for exposing the photosensitive surface of a xerographic plate at an imaging station A of the apparatus. The xerographic plate may take the form of a flexible photoconductive belt arranged on a belt assembly generally indicated by the reference numeral 11.

The photoconductive belt assembly 11 is slidably mounted upon a support bracket secured to the frame of the machine and is adapted to drive an endless photoreceptor belt 12 in the direction of the arrow as shown in FIG. 2 at a constant rate. During this movement of the belt, the reflected light image of an original on the platen is flashed, at the imaging station A, upon the xerographic surface of the belt, at high speed measured in microseconds. The belt surface that intercepts the light rays comprises a layer of photoconductive material, such as selenium, on a conductive, backing, that is sensitized prior to expose by means of a charging corona generator device indicated at 13.

The flash exposure of the belt surface to the light image discharges the photoconductive layer in the areas struck by light, whereby there remains on the belt a latent electrostatic image in image configuration corresponding to the light image projected from the original document O on the supporting platen. As the belt surface continues its movement, the electrostatic image passes into and through a processing station, generally denoted as B, which includes a developing station C, a transfer station D, and a photoreceptor cleaning station E.

The developing station C includes a developer assembly generally indicated by the reference numeral 14, where the belt is maintained in a flat condition. The developer assembly 14 comprises a vertical conveying mechanism which carries developing material to the upper part of the belt assembly 11 where the material is dispensed and directed to cascade down over the upwardly moving inclined photoreceptor belt 12 in order to provide development of the electrostatic image.

As the developing material is cascaded over the xerographic plate, toner particles in the development material are deposited on the belt surface to form powder images. As toner powder images are formed, additional toner particles are supplied to the developing material in proportion to the amount of toner deposited on the belt during xerographic processing. For this purpose, a toner dispenser, generally indicated by reference numeral 15, is used to accurately meter toner to the developer material in the developer assembly 14.

The developed electrostatic image is transported by the belt to a transfer station D where a sheet of copy paper is moved at a speed in synchronism with the moving belt in order to accomplish transfer of the developed image. There is provided at this station a sheet transport mechanism, generally indicated at 16, adapted to transport sheets of paper from a paper handling mechanism, generally indicated by the reference numeral 18, to the developed image on the belt at D.

After the sheet is stripped from the belt 12, it is conveyed into a fuser assembly, generally indicated by the reference numeral 21, wherein the developed and transferred xerographic powder image on the sheet material is permanently affixed thereto. After fusing, the finished copy is discharged from the apparatus at a suitable point for collection externally of the apparatus.

After the sheet has been stripped from the belt 12, the belt proceeds through the cleaning station E where the remaining image is "erased" from the belt by discharging the belt and the remaining toner particles are brushed off the belt and recycled.

Suitable drive means may be arranged to drive the photoreceptor belt 12 in conjunction with timed flash exposure of an original document O to be copied, to effect conveying and cascasde of toner material, to separate and feed sheets of paper and to transport the same across the transfer station D and to convey the sheet of paper through the fuser assembly in timed sequence to produce copies of the original.

Figure 3:
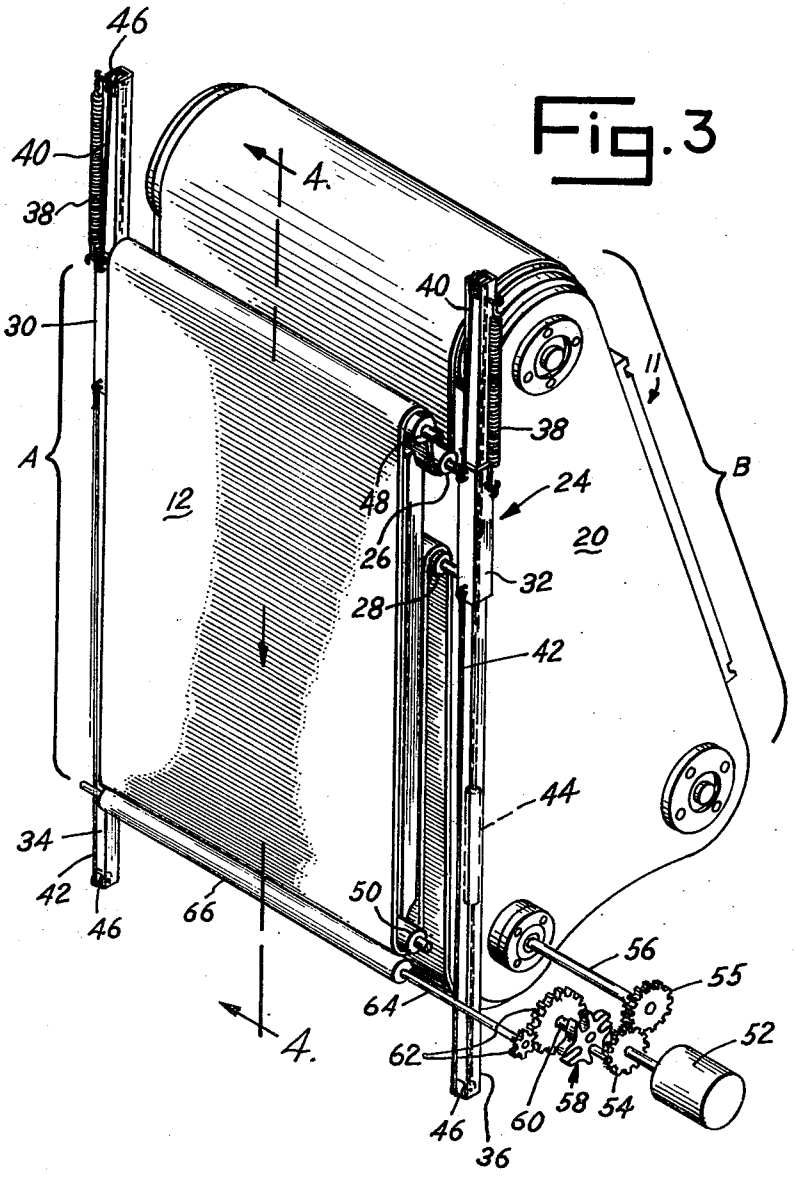
FIG. 3 is a perspective view of the preferred embodiment of a photoreceptor assembly of the present invention.

The photoreceptor belt comprises a photoconductive layer of a suitable material, such as selenium, which is the light receiving surface and imaging medium for the apparatus, on a conductive backing. The belt is journaled for continuous movement upon three rollers 17, 18 and 19 located with parallel axes at approximately the apex of a triangle. The rollers 17, 18 and 19 are journaled on bearings in two side plates 20, as shown in FIG. 3, each having the general configuration of a triangle. The side plates, in turn, may be removably mounted to the main frame 22 of the machine.

It is believed that the foregoing description is sufficient for the purpose of this application to exhibit the general construction and operation of an electrostatic copier in which the assembly and method of the present invention may be incorporated.

The present invention relates to a photoreceptor method and assembly in which the photoreceptor belt 12 may be stopped at the imaging station A during light imaging while the remaining portions of the flexible endless photoreceptor belt will continue to move at a constant velocity through the processing station B, for development and transfer to the copy sheet.

In the photoreceptor method and assembly of the present invention, velocity control means comprising a movable shuttle mechanism, generally indicated by reference numeral 24, is positioned in the path of travel of the photoreceptor belt 12 so as to simultaneously store and dispense portions of the photoreceptor belt.

Shuttle mechanism 24 comprises a pair of elongate rollers 26 and 28 having a width somewhat wider than that of belt 12 and extending transversely of the belt. Rollers 26 and 28 are mounted to a pair of brackets 30 and 32 for rotation upon axes perpendicular to the direction of travel, indicated by the arrows in FIGS. 3–5, of the flexible photoreceptor belt 12.

Each of the brackets 30 and 32 are slidably mounted on a pair of spaced parallel channels 34 and 36 which extend vertically at the light imaging station A of the photocopy apparatus. A spring or other suitable urging means 38 extends between the end of each of the channels 34 and 36 and the respective brackets to load the brackets upwardly as viewed in FIG. 3. In addition, suitable flexible members, such as wires or cables 40 and 42, are attached at one end to the top and bottom, respectively, of each of the brackets 30 and 32, and at their other ends to an inertia counterbalancing mass 44. The inertia counterbalancing mass 44 comprises a weight of sufficient mass which is adapted to move up and down in each of the channels 34 and 36 to counterbalance the inertia resulting from movement of the shuttle mechanism 24 along the channels. Each of the flexible cables 40 and 42 passes around a suitable direction reversing member, such as pulleys 46, at the top and bottom ends of the channels. The channels 34 and 36 may be attached either to the main frame 22 of the apparatus or, preferably, to the side plates 20 by suitable fastening means (not shown).

A roller 48 is also positioned at the top of the imaging station A as shown in FIG. 3. Roller 48 also is at least slightly wider than the belt 12 and extends transversely across the belt. Roller 48 is an idler roller which is journaled for rotation about an axle, the latter of which may also be journaled at each end in suitable bearings to a support extending from side plates 20 (neither of which is shown). Another roller 50 also extending transversely across the belt 12 is positioned in spaced relationship from roller 48 at the bottom of the imaging station A. Likewise, roller 50 may also be journaled to suitable supports (not shown) for rotation.

Main drive motor 52, as shown in FIG. 3, is provided for driving one of the rollers of the belt assembly 11 at a substantially constant speed. For example, as shown in FIG. 3, this motor 52 drives a suitable drive gear 54 which, in turn, drives gear 55, shaft 56 and roller 17. In addition, gear 54 may be fitted with a suitable indexing mechanism, generally indicated by the reference numeral 58, such as a conventional Geneva mechanism, so as to rotate a shaft 60 a predetermined amount each time the gear 54 rotates one or several revolutions. In turn, suitable gearing 62 is provided to amplify the rotational movement of the shaft 60, which movement, in turn, is transmitted by way of drive shaft 64 to a pinch roll 66 which pinches the photoreceptor belt 12 between itself and idler roller 50.

Figure 4:
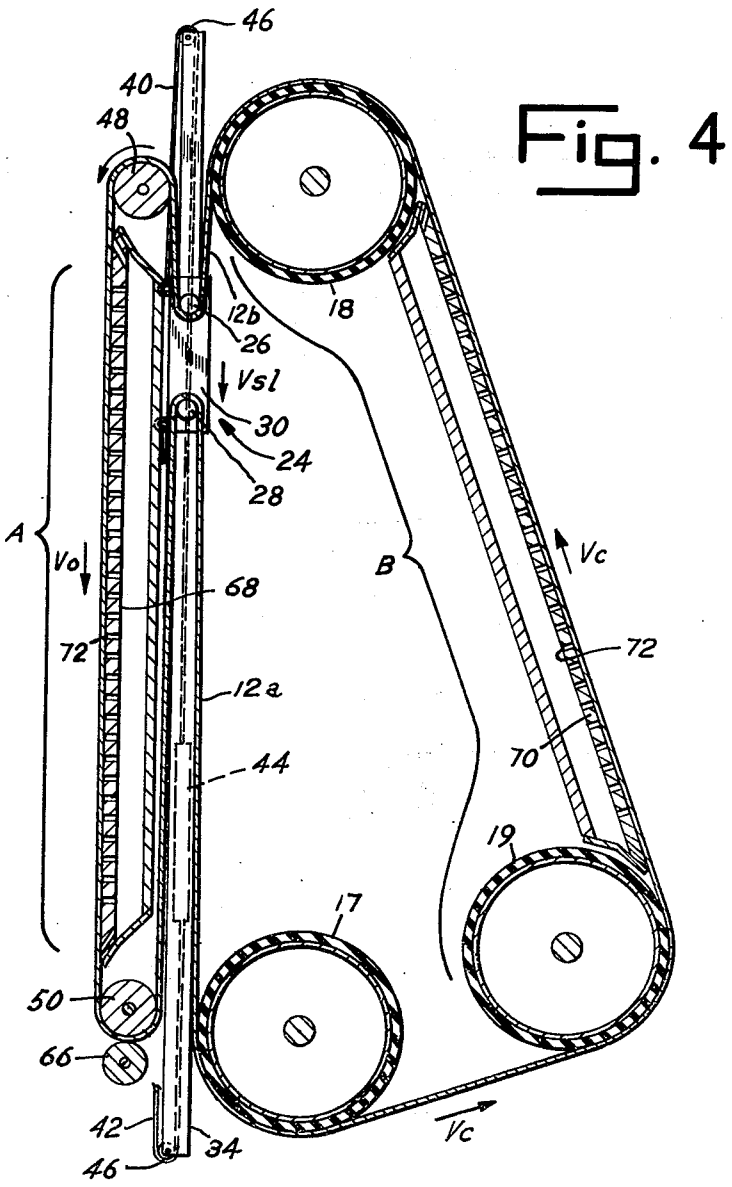
FIG. 4 is a cross sectioned elevation view of the photoreceptor assembly, as viewed substantially along line 4—4 of FIG. 3, showing the components of the assembly just prior to commencement of exposure of the photoreceptor.
Figure 5:
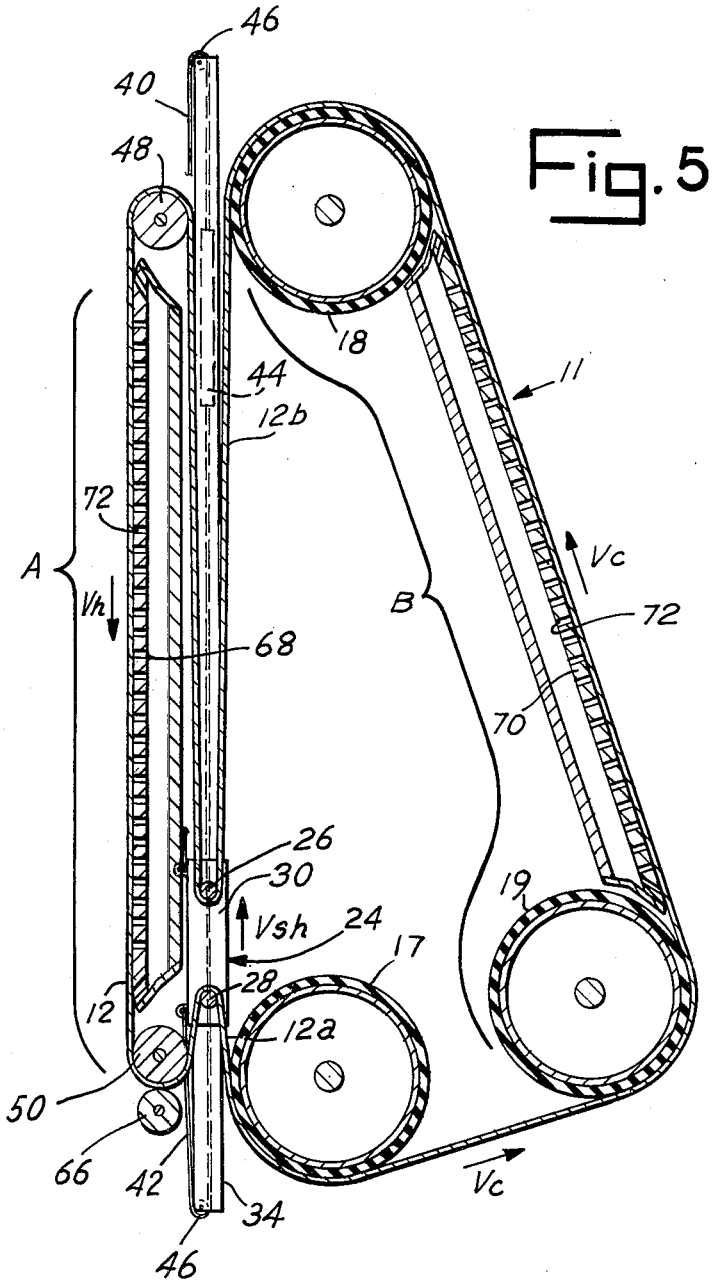
FIG. 5 is a cross-sectioned elevation view of the photoreceptor assembly shown in FIG. 4, but just after exposure of the photoreceptor.

The belt assembly 11 also preferably includes a flat front plate 68 and rear flat plate 70, as shown in FIGS. 4 and 5, at the faces adjacent the imaging station A and processing station B, respectively. These plates 68 and 70 may be secured to the side plates 20 by suitable fastening means (not shown). Each of the plates 68 and 70 is formed with a plurality of apertures 72.

The plates 68 and 70 serve as vacuum holddown plates for supporting the photoreceptor belt 12 flat against the plates during movement thereof on the assembly 11. The apertures 72 are in communication with a plenum chamber which, in turn, is connected by suitable ducts to a vacuum chamber for drawing air inwardly through the apertures 72 and thereby holding by vacuum the adjacent runs of the belt 12.

From the foregoing description, and referring particularly to FIGS. 3-5, the endless photoreceptor belt 12 passes over rollers 17, 19 and 18, respectively, in the processing station B of the assembly, under roller 26 of the shuttle mechanism 24, over upper idler roller 48, through the imaging station A, between lower roller 50 and pinch roller 66, over roller 28 of the shuttle mechanism 24 to roller 17.

The operation of the present invention will now be described.

An original document O to be copied is placed on platen P and is illuminated by suitable illumination means. The reflected image from the document will pass through a focusing lens L and will be displayed upon the portion of the photoreceptor belt 12 at the imaging station A. Upon commencement of such light imaging, i.e. upon commencement of exposure of the photoreceptor, the motor 52 will be energized, driving roller 17 at a constant speed to draw the photoreceptor belt 12 through the processing station B at a constant speed $V_c$.

Upon the commencement of exposure of the photoreceptor belt 12 at the imaging station A, the shuttle mechanism 24 will be in its upper position and the inertia counterbalancing mass 44 at its lower position, as shown in FIG. 4. The pinch roll 66 will not be driven at this time and will brake roller 50 and prevent it from rotating, thereby preventing movement of that portion of the photoreceptor belt 12 which is being exposed at the imaging station A. Thereby, the speed of the belt $V_o$ is zero. However, since roller 17 is rotating and drawing the right hand loop 12*a* of the photoconductor belt 12 downward, as viewed in FIG. 4, so as to dispense a portion of the belt to the processing station B, the loop 12*a* will pull downward on roller 28 of the shuttle mechanism 24 causing the bracket 30 to move downward at a velocity $V_{sl}$. $V_{sl}$ is equal to $(V_c)/2$, i.e. one half of constant velocity of the photoconductor belt 12 through the processing station B. It will be seen that as the bracket 30 moves downward, as shown in FIG. 4, whatever length of photoconductor belt 12*a* is drawn into the processing station B, the same length will be discharged from the processing station at the top of the unit and will become part of steadily lengthening loop 12*b*. Thereby, this discharged portion 12*b* of the photoconductor belt will not pass into the imaging station A, since its slack will be taken up by the upper roller 26 of the shuttle mechanism 24 which is moving downwardly, and will instead be stored. Thus, even though the portion of the photoconductor belt 12 which is in the processing station B continues to move at a constant velocity $V_c$ while imaging is occurring in the imaging station A, the portion of photoconductor belt which is being imaged at the imaging station is stopped during imaging.

The length of time that it will take the bracket to move from its upper position, as shown in FIG. 4, to its lower position, as shown in FIG. 5, is approximately equal to the length of time that it takes to complete imaging of one copy of the original document O at the imaging station A.

When imaging is completed and the shuttle mechanism 24 has assumed its lowermost position, as shown in FIG. 5, the indexing mechanism 58 will index the pinch roll 66 so as to drive the photoconductor belt 12 downwardly, as viewed in FIG. 5, at a speed $V_h$. The speed $V_h$ is greater than the constant velocity $V_c$ and causes the loop 12*a* of the photoconductor belt 12 which has just been exposed at the imaging station A to tend to slack at the shuttle mechanism 24. However, this loop 12*a* does not slack, since the springs 38 retract the shuttle mechanism upwardly at a velocity $V_{sh}$ as fast as the belt is fed to it from the imaging station A. $V_{sh}$ is equal to $(V_h)/2$. Whatever length of photoconductor belt 12 is fed at high velocity between the rotating pinch roll 66 and roller 50 will be stored by the upwardly moving shuttle assembly 24 and will be replaced at the imaging station A by the long loop 12*b* of photoreceptor which has been stored above the shuttle mechanism 24 and which will now be dispensed to the imaging station A. Thereby, the just exposed portion of the photoconductor belt 12 will be fed at a high velocity from the imaging station A and a new ready to be exposed portion of photoconductor belt will be dispensed at the same high velocity to the imaging station A. It will be seen that, even though the velocity $V_h$ of the photoconductor belt 12 at the imaging station is high, the velocity of the photoconductor belt through the processing station B will continue to be constant at $V_c$. The rapid return inertia of the shuttle assembly 24 to its upper position, as shown in FIG. 4, will be balanced by the inertia counterbalancing mass 44.

Upon consideration of the foregoing description of the preferred embodiment of the present invention, it will be seen that the invention makes it possible to maintain the velocity of the photoreceptor belt 12 constant through the processing station B of the photocopier and, yet, will allow that portion of the photoreceptor belt which is at the imaging station to be stopped during light imaging and then be rapidly removed and a new portion of photoreceptor belt be positioned for imaging of the next copy. This ability to start and stop the photoreceptor belt at the imaging station of the photocopy apparatus avoids the possibility of smearing of the image during exposure of the photoreceptor belt, since no relative motion exists between the stopped photoreceptor belt and the document being imaged. Even more importantly, the sensitivity of the photoreceptor material may be substantially decreased without sacrificing quality of copy, thereby allowing the use of photoreceptor materials and substrates which have superior mechanical qualities, such as crack resistance, abrasion resistance, good substrate adhesion, etc. Conversely, if high sensitivity photoreceptor materials are employed in the photoreceptor belt, copy rates may be substantially increased to the point that maximum copy rate actually will no longer be limited by the imaging process, the latter being the limitation in present copying systems.

It will be understood that an important feature of the present invention is the provision of means between the imaging and processing stations of a photocopy apparatus which is capable of simultaneously storing and dispensing portions of the photoreceptor belt. Although the preferred embodiment of such means is disclosed herein as being linearly movable, other constructions and directions of movement, e.g. rotative movement, may be employed in practicing the present invention without departing from the spirit and scope of the present invention. It will also be understood that the embodiment of the present invention which has been described is merely illustrative of an application of the principles of the invention. Numerous modifications may be made by those skilled in the art without departing from the true spirit and scope of the invention.

What is claimed is:

1. A photoreceptor system for a photocopy apparatus including flexible endless photoreceptor means, and drive means for driving said photoreceptor means through processing and imaging stations, wherein the improvement comprises in combination therewith velocity control means for controlling the velocity of said photoreceptor means such that the velocity thereof at said processing station is substantially constant and the velocity thereof at said imaging station may simultaneously be less than said substantially constant velocity, said velocity control means comprising means for simultaneously storing and dispensing portions of said photoreceptor means.

2. The system of claim 1 wherein said velocity control means comprises movable shuttle means.

3. The system of claim 1 wherein said means for simultaneously storing and dispensing portions of said photoreceptor means includes movable bracket means, a pair of roller means mounted for rotation on said bracket means about an axis extending transverse to the direction of movement of said photoreceptor means, said photoreceptor means being trained about one of said roller means as it moves from said processing station to said imaging station and trained about the other of said roller means as it moves from said imaging station to said processing station, and means for moving said bracket means and pair of roller means to control the velocity of said photoreceptor means at said imaging station at said velocity less than said constant velocity.

4. The system of claim 3 wherein said velocity control means includes inertia balancing means to balance the inertia of said pair of rollers when they are moved.

5. The system of claim 3 wherein said velocity control means stops said photoreceptor means at said imaging station while the image to be copied is being transferred to said photoreceptor means, and imparts velocity to said photoreceptor means at said imaging station greater than said constant velocity after the image to be copied has been transferred to the photoreceptor means.

6. The system of claim 3 wherein the said velocity control means comprises movable shuttle means.

7. The system of claim 6 wherein the movement of said shuttle means is linear.

8. The system of claim 3 wherein a linear component of the velocity of the movable pair of roller means is about one half of said constant velocity.

9. The system of claim 3 wherein said means for moving said pair of roller means includes means for indexing said photoreceptor means.

10. The system of claim 1 including first, second and third roller means about which said photoreceptor means is trained as it moves from said processing station to said imaging station, fourth, fifth and sixth roller means about which said photoreceptor means is trained as it moves from said imaging station to said processing station, each of said roller means being mounted for rotation about an axis transverse to the direction of movement of said photoreceptor means, mounting means mounting said second and fifth roller means, and means for moving said mounting means to effect simultaneous movement of said second and fifth roller means relative to said first, third, fourth and sixth roller means to maintain the velocity of said photoreceptor means at said processing station at said substantially constant velocity and at said imaging station at the velocity less than said constant velocity.

11. The system of claim 10 wherein said second and fifth roller means comprises said means for storing and dispensing portions of said photoreceptor means.

12. The system of claim 10 including inertia balancing means to balance the inertia of said second and fifth roller means when said roller means are moved.

13. The system of claim 10 wherein the simultaneous movement of said second and fifth roller means stops said photoreceptor means at said imaging station while the image to be copied is being transferred to said photoreceptor means, and imparts a velocity to said photoreceptor means at said imaging station greater than said constant velocity after the image to be copied has been transferred to the photoreceptor means.

14. The system of claim 10 wherein the movement of said second and fifth roller means is linear.

15. The system of claim 10 wherein a linear component of the velocity of said movable second and fifth roller means is about one half of said constant velocity.

16. The system of claim 10 wherein said means for moving said second and fifth roller means includes means for indexing said photoreceptor means.

17. The system of claim 16 wherein said indexing means drives one of said first, third, fourth and sixth roller means.

18. A method of photocopying comprising the steps of driving flexible endless photoreceptor means through imaging and processing stations of a photocopy apparatus, maintaining said photoreceptor means at a velocity less than a given velocity at said imaging station while transferring the image to be copied thereto, simultaneously moving said photoreceptor means at said given velocity through said processing station, and simultaneously storing and dispensing portions of said photoreceptor means.

* * * * *